US007396268B2

(12) United States Patent
Hyjek

(10) Patent No.: US 7,396,268 B2
(45) Date of Patent: Jul. 8, 2008

(54) SAFETY SIGNALING APPARATUS FOR WATERCRAFT

(76) Inventor: Jan P. Hyjek, 163 Old Country Rd., West Enfield, ME (US) 04493

( * ) Notice: Subject to any disclaimer, the term of this patent is extended or adjusted under 35 U.S.C. 154(b) by 271 days.

(21) Appl. No.: 11/105,284

(22) Filed: Apr. 13, 2005

(65) Prior Publication Data

US 2005/0255763 A1 Nov. 17, 2005

Related U.S. Application Data

(60) Provisional application No. 60/562,130, filed on Apr. 15, 2004.

(51) Int. Cl.

| | |
|---|---|
| ***B63B 22/00*** | (2006.01) |
| *B63B 17/00* | (2006.01) |
| *B63B 45/04* | (2006.01) |
| *G09F 17/00* | (2006.01) |
| *F16M 13/00* | (2006.01) |

(52) U.S. Cl. ..... 441/11; 114/343; 114/364; 116/26; 116/173; 248/511; 248/519

(58) Field of Classification Search ..... 441/11; 116/26, 173; 73/178 R; 362/477; 114/343, 114/364; 248/511, 519; 52/298
See application file for complete search history.

(56) References Cited

U.S. PATENT DOCUMENTS

| | | | | |
|---|---|---|---|---|
| 1,279,669 | A | 9/1918 | Deming | |
| 3,760,441 | A | 9/1973 | Handelman | |
| 3,797,450 | A | 3/1974 | Frisbee | |
| 3,872,529 | A | 3/1975 | Wainwright | |
| 3,895,348 | A * | 7/1975 | Palermo | 340/472 |
| 4,035,856 | A | 7/1977 | Oberg | |
| 4,122,796 | A * | 10/1978 | Pressler et al. | 116/277 |
| 4,157,075 | A | 6/1979 | Kirvutza | |
| 4,228,556 | A | 10/1980 | Searls | |
| 4,599,965 | A | 7/1986 | Johnson | |
| 4,632,354 | A | 12/1986 | Asciutto | |
| 4,962,720 | A | 10/1990 | Leffel | |
| 5,398,026 | A | 3/1995 | Handsaker | |
| 6,057,787 | A | 5/2000 | Kell et al. | |
| 6,250,248 | B1 | 6/2001 | Patera | |
| 6,481,366 | B1 | 11/2002 | Patera | |
| 6,598,556 | B1 * | 7/2003 | Peters | 116/50 |
| 6,637,718 | B2 | 10/2003 | Wilson | |
| 2007/0089663 | A1 * | 4/2007 | Dunbar et al. | 116/173 |

* cited by examiner

*Primary Examiner*—Lars A Olson
*Assistant Examiner*—Daniel V Venne
(74) *Attorney, Agent, or Firm*—Anthony D. Pellegrini

(57) ABSTRACT

An improved safety signaling apparatus intended to be used with watercraft to increase the visibility of the watercraft to others, incorporating a mast-supported signaling device, a base member for attachment to the watercraft, and a retention member removably attaching the mast assembly to the base member. The retention member is suitably adapted to maintain the mast assembly in a fixed orientation in relation to the base member under certain conditions, namely ordinary operation of the watercraft, and to permit independent movement of the mast relative to the base member under different conditions, namely when the mast is in danger of damage or for independent use or storage.

8 Claims, 7 Drawing Sheets

SAFETY SIGNALING APPARATUS FOR WATERCRAFT

CROSS REFERENCE TO RELATED APPLICATION

This application claims priority to a provisional application, U.S. Ser. No. 60/562,130, filed Apr. 15, 2004, entitled Safety Signaling Warning Device For Personal Water Craft, by Hyjek, Jan P., which, which is hereby incorporated by reference.

BACKGROUND OF THE INVENTION

1. Technical Field

The invention relates generally to the field of safety devices and is directed to an apparatus adapted to be mounted on a watercraft. More specifically, the invention is directed to an improved safety signaling apparatus incorporating a mast, for use on personal watercraft, such as kayaks and canoes, making such watercraft more visible to others when in use while also incorporating technology to improve the durability and performance of said signaling apparatus.

2. Description of Prior Art

Signaling devices for vehicles in general and for watercraft in particular are well-known in the art. Signaling devices incorporating masts have been known as least as early as Deming, U.S. Pat. No. 1,279,669, issued Sep. 24, 1918. Deming discloses a flagstaff holder to be clamped onto a car grill. Kirvutza, U.S. Pat. No. 4,157,075, issued Jun. 5, 1979, discloses a flag holder for use on bicycles, incorporating a mechanism to move the flagstaff when the bicycle is operated. Wilson, U.S. Pat. No. 6,637,718, issued Oct. 28, 2003, discloses a flagstaff holder adapted to attach to a trailer ball hitch, having an adjustable height. None of the foregoing inventions disclose a marine use for the disclosed signaling device, nor describe an attachment means for the flag holders adapted for use on a planar surface. Asciutto, U.S. Pat. No. 4,632,354, issued Dec. 30, 1986, does disclose a mast mounting means for use on a planar surface, though not specifically for marine use. Asciutto uses a threaded bolt and a plastic collar, with the bolt secured to the surface by the collar. Both the bolt and the collar contain apertures, which are aligned, to permit insertion of a mast. As assembled, the mast, collar, and bolt are in a fixed orientation to each other and to the planar surface.

Signaling devices utilizing flag masts for marine uses are also well-known. Handelman, U.S. Pat. No. 3,760,441, issued Sep. 25, 1973, discloses a floating buoy with a telescoping mast. Wainwright, U.S. Pat. No. 3,872,529, issued Mar. 25, 1975, discloses a mast assembly adapted to be worn on a diver's belt. Oberg, U.S. Pat. No. 4,035,856, issued Jul. 19, 1977, discloses a safety flag adapted to be carried on a life jacket worn by water skiers. Searls, U.S. Pat. No. 4,228,556, issued Oct. 21, 1980, discloses a floating lifesaving device incorporating a mast and flag. Johnson, U.S. Pat. No. 4,599,965, issued Jul. 15, 1986, discloses a pivoting mast assembly adapted to be worn on a diver's belt. While all the foregoing inventions make use of a mast and a flag as the primary signaling device, none are adapted for mounting directly on watercraft.

The prior art discloses mast-based signaling devices adapted for use on watercraft. Frisbee, U.S. Pat. No. 3,797,450, issued Mar. 19, 1974, discloses a flag and mast assembly mountable on a boat. The Frisbee device comprises a containment tube for the flag and mast and a means for ejecting the flag and mast from the containment tube and a means for retracting the flag and mast into the containment tube.

Pressler, et al., U.S. Pat. No. 4,122,796, issued Oct. 31, 1978, discloses a mast and flag assembly mountable on the forward deck of a boat, with a hinged base allowing the mast to be folded flat against the deck or raised to a substantially vertical position. Leffel, U.S. Pat. No. 4,962,720, issued Oct. 16, 1990, discloses a retractable, telescoping mast stored below-decks and extendable above deck. The mast may be raised by powered or manual means. Hansaker, U.S. Pat. No. 5,398,026, issued Mar. 14, 1995, also discloses a retractable, telescoping mast stored below-decks and extendable above deck. The Hansaker device is powered, may be mounted in the stem of a boat, and may carry a signaling device other than a flag, such as a light. Kell, et al., U.S. Pat. No. 6,057,787, issued May 2, 2000, discloses a flag and mast assembly that is automatically raised when the watercraft onto which it is mounted is traveling at a low rate of speed. The Kell device is powered and may incorporate a telescoping mast. Patera, U.S. Pat. No. 6,250,248, issued Jun. 26, 2001, and Patera, U.S. Pat. No. 6,481,366, issued Nov. 19, 2002, disclose a mast-mounted signaling device mountable on the bumper of a personal watercraft, the device having a pendulum mechanism to retain the mast in an upright orientation even when the watercraft has capsized. The signaling device may be a flag or another device, such as a light or siren. When the watercraft is stopped the mast is in a vertical orientation, and when the watercraft is in motion the mast is angled rearward.

None of the foregoing art discloses a simple, inexpensive safety signaling apparatus that can be easily and quickly mounted onto and removed from the upper surface of any type of watercraft, but especially small watercraft such as kayaks and canoes. Frisbee, Pressler, Leffel, Hansaker, and Kell all disclose devices in which the mast must be raised in order to achieve its signaling function, unlike the present invention which is always available. None of these devices contain the present invention's safety feature of a quick-release for the mast, which minimizes damage to the mast or potentially dangerous interference with the watercraft. Hansaker and Kell require complex powered mechanisms to deploy the masts. The Patera inventions require complex pendulum mechanisms to retain the mast in the desired orientation.

It is an objective of the present invention to provide a useful, inexpensive safety g apparatus that can be easily and quickly mounted onto and removed from the upper of any type of watercraft, but especially small Watercraft such as kayaks and canoes.

It is a further object of the present invention to provide a safety signaling apparatus adapted to be readily noticeable without interfering with the operation of the watercraft.

It is a further object of the present invention to provide a safety signaling apparatus that reduces the risk of being damaged.

Other objects of the present invention will be readily apparent from the description that follows.

SUMMARY OF THE INVENTION

In one aspect, the present invention is directed to a safety signaling apparatus intended to be used with watercraft to increase the visibility of the watercraft to others and thus increase safety during operation of the watercraft. While many different types of watercraft may utilize the present invention, it is contemplated that the primary use for the present invention will be for small personal watercraft, such as kayaks and canoes.

The invention comprises four principle components: a base member, a retention member, a mast, and a signaling device. The base member is adapted to be fixed to the watercraft, and the signaling device is adapted to be fixed to the mast. The retention member is suitably adapted to attach to both the base member and the mast so as to maintain the mast in a fixed orientation in relation to the base member under certain conditions and to permit independent movement of the mast relative to the base member under different conditions. During normal operation of the watercraft, the mast remains in a fixed orientation in relation to the base member to afford the greatest visibility and thus safety benefits. However, under other conditions, specifically when forces applied to the mast may cause damage to the mast or even interfere with the safe operation of the watercraft, the retention member permits independent movement of the mast relative to the base member. The mast is most commonly subjected to such forces when the mast comes into contact with low hanging obstructions, such as tree branches or low overpasses, and when the watercraft inverts, thus dragging the mast through the water. In such circumstances, because the retention member permits independent movement of the mast relative to the base member, the effect of such forces on the mast is minimized. Thus, the mast is less likely to break off, and is less likely to interfere with the operation of the watercraft. Further, the use of the retention member permits the mast to be quickly and easily removed from the watercraft to be waived by the user in an emergency, or for storage purposes.

The foregoing is achieved in the preferred embodiment by incorporating a two-part retention member, whereby one part is attached to the base member and the other part is attached to the mast, and the two parts are attached to each other. A force applied to the mast causes the two parts of the retention member to detach, thus permitting free movement of the mast in relation to the watercraft. A security member may be employed between the two parts of the retention member to retain the mast with the watercraft after the retention member separates.

The mast component of the present invention is preferably made of fiberglass for strength and flexibility and manufactured in a fluorescent hue for better visibility. As installed on the watercraft, the mast is oriented substantially upright, with a rearward angle. The upright orientation allows for better visibility, and the rearward angle allows the signaling device, if it is a flag, to hang freely, even in the absence of wind. The rearward angle also directs the mast away from the user of the watercraft when the apparatus is mounted behind the user on the rear deck of the watercraft.

The signaling component of the present invention may be a simple flag, or it may be one or more other devices which are visually and/or audibly noticeable. Where a flag is used, it is preferred to by constructed of a fluorescent, flexible plastic material, to provide greater visibility and durability. Other signaling devices may comprise a siren, a bell, a light, a communication antenna, a GPS device, or a combination of two or more of such devices.

Other features and advantages of the invention are described below.

DETAILED DESCRIPTION OF THE INVENTION

Figure 1:
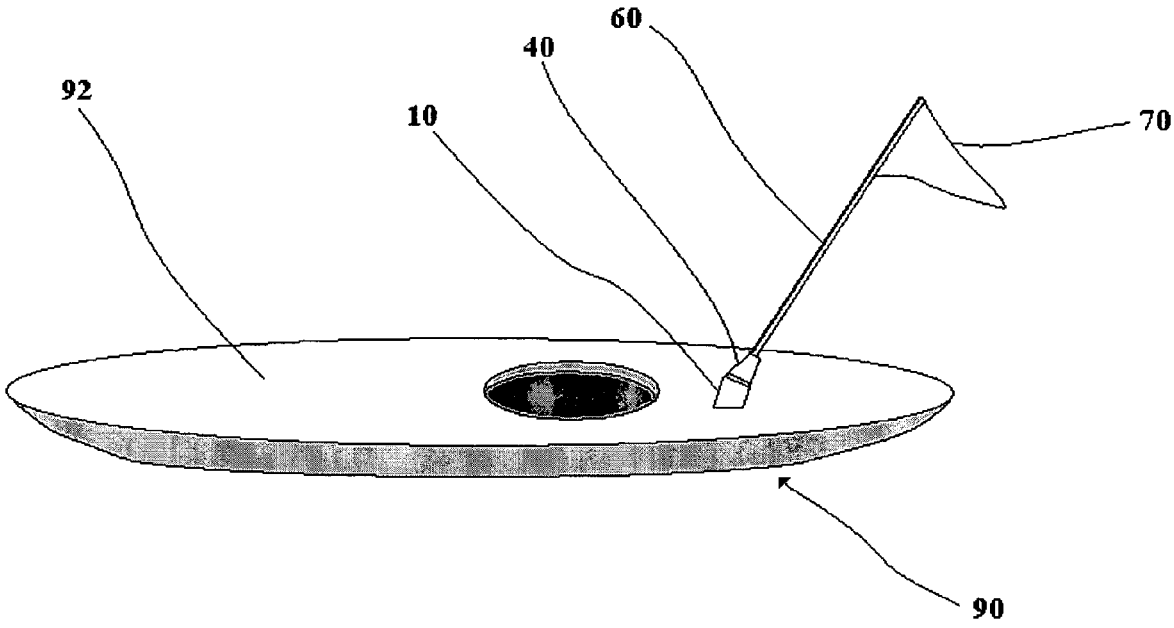
FIG. 1 is a perspective view of the invention as mounted on a personal watercraft.
Figure 2:
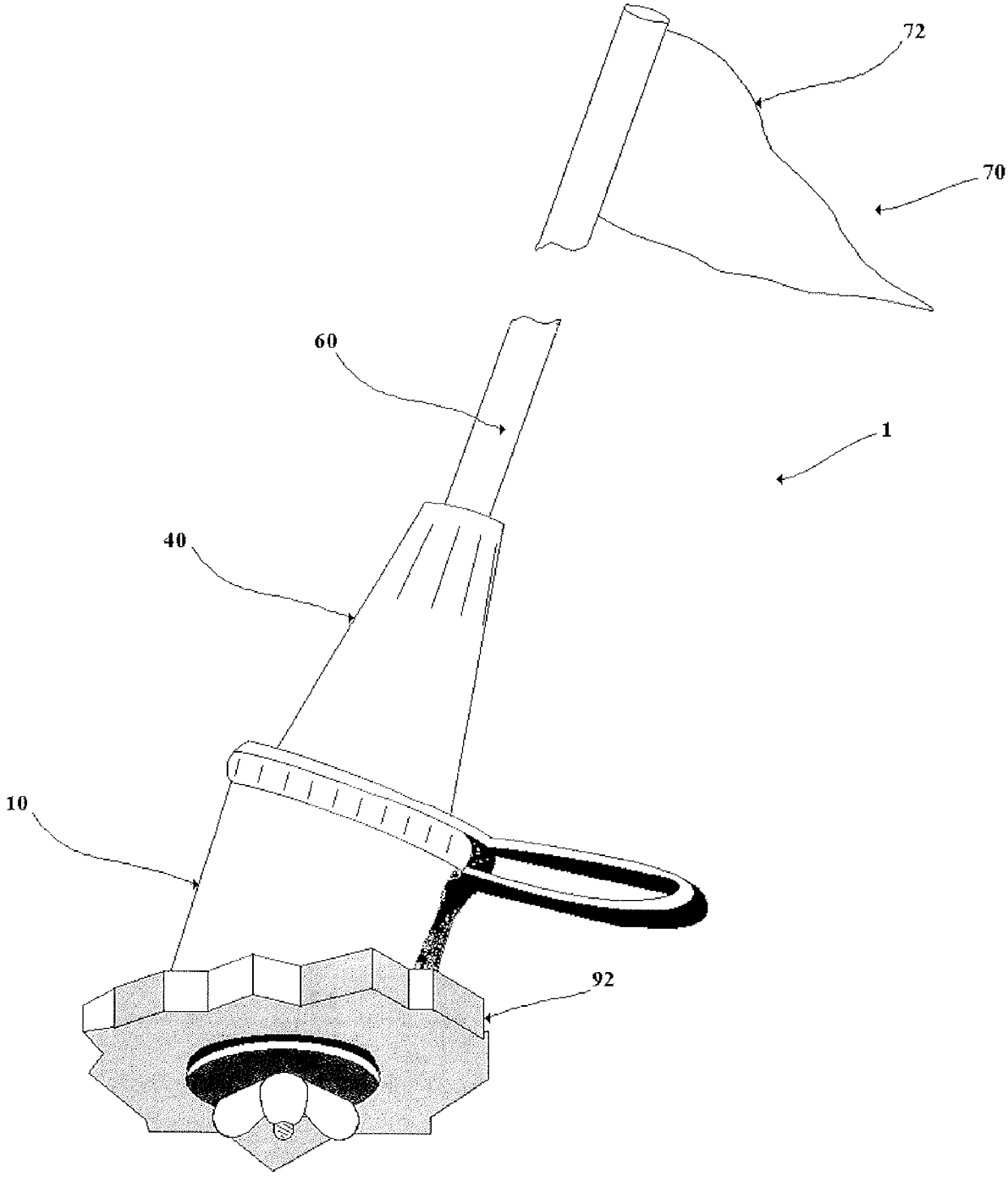
FIG. 2 is a perspective view of the basic components of the invention.

The present invention is a safety signaling apparatus intended to used with a personal watercraft, as shown in FIG. 1. The invention comprises four principle components: a base member 10, a retention member 40, a mast 60, and a signaling device 70. See FIGS. 1 and 2. The base member 10 of the present invention is suitably adapted to be removably attached to an upper surface 92 of a watercraft 90. The base member 10 is intended to remain attached to the upper surface 92 of a watercraft 90 except for maintenance purposes, repair or replacement of the base member 10, or installation of the safety signaling apparatus 1 on another watercraft, at which time the base member 10 may be easily removed from the watercraft 90. The base member 10 is removably attached to the upper surface 92 of a watercraft 90 by a watercraft attachment means and is removably attached to the retention member 40 by a retention attachment means. The watercraft attachment means and the retention attachment means may be any well-known means for removably attaching solid objects to each other, including the use of fasteners, snaps, slots, and the like.

Figure 7:
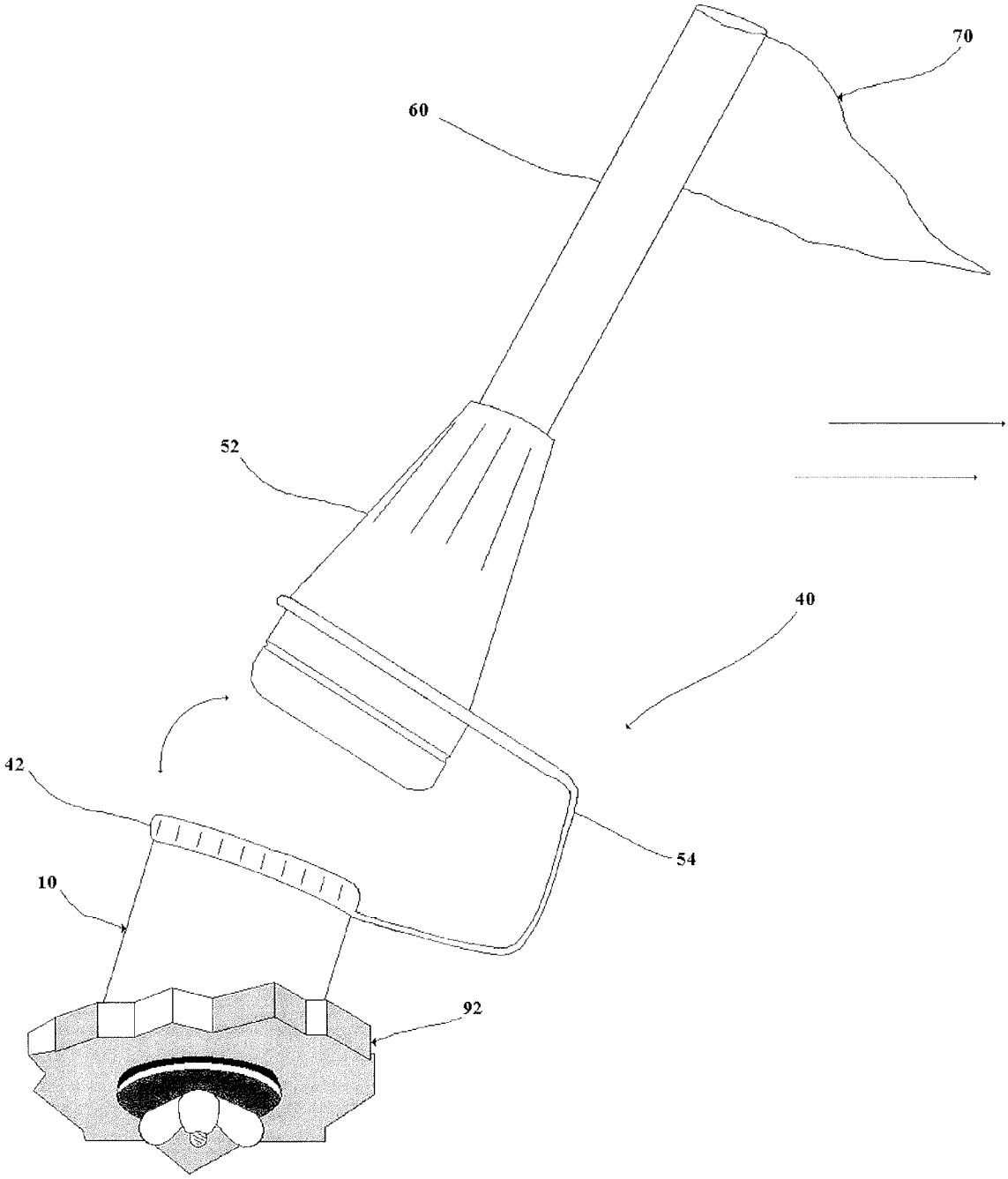
FIG. 7 is a perspective view of the invention depicting the detachment of the attachment sub-member from the holding sub-member.

The retention member 40 is suitably adapted to be removably attached to the base member 10 by the retention attachment means. The retention member 40 also is suitably adapted to retain the mast 60. In normal operation, the retention member 40 will be attached to the base member 10, thereby causing the mast 60 to be carried by the watercraft 90. Detachment of the retention member 40 from the base member 10 may be done to facilitate storage of the safety signaling apparatus 1. The retention member 40 also comprises a quick release means to permit independent movement of the mast 60 relative to the base member 10 during operation of the watercraft 90 to avoid damage to the mast 60, such as when the mast 60 comes in contact with an object or when the watercraft 90 becomes inverted, as described above. See FIG. 7. The quick release means may be any well-known means for removably attaching solid objects to each other without resorting the use of tools, including the use of snaps, slots, and the like.

Figure 3:
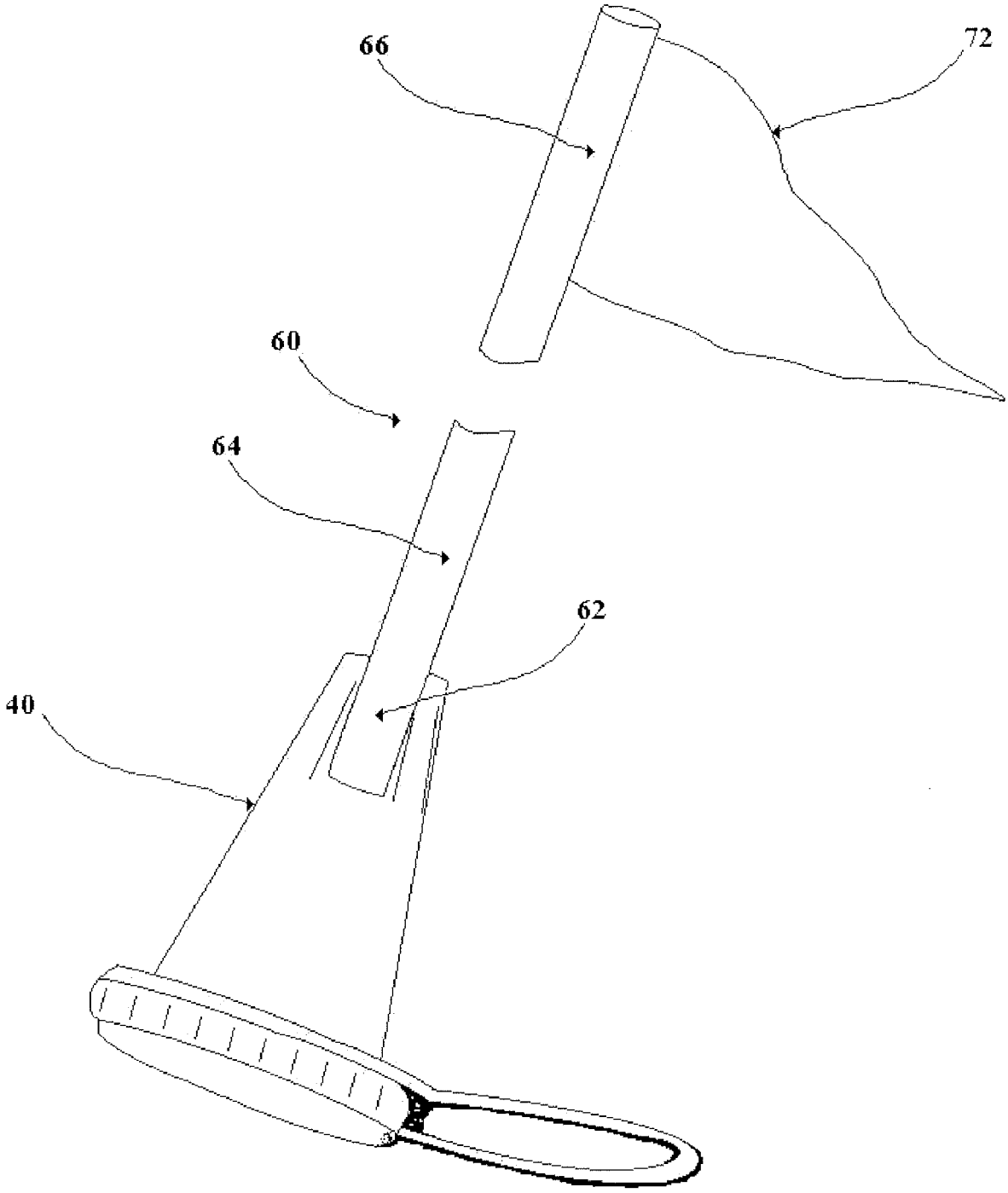
FIG. 3 is a perspective view of the mast assembly as intended to be used with the retention member.

The mast 60 has a retention end 62, a shaft 64, and a signal end 66, wherein the retention end 62 and the signal end 66 are located at opposite ends of the shaft 64. See FIG. 3. The shaft 64 of the mast 60 must be flexible to accommodate ordinary forces acting on the mast 60, such as wind resistance, yet have sufficient rigidity to support the signaling device 70 in a substantially upright orientation, above the upper surface 92 of the watercraft 90, without undue bending. In the preferred embodiment, the mast 60 is constructed of fiberglass. In another preferred embodiment, the mast 60 is fluorescent to provide increased visibility.

The retention end 62 of the mast 60 is suitably adapted to be removably inserted into the retention member 40. The signal end 66 of the mast 60 is suitably adapted to carry the signaling device 70. The mast 60 is intended to remain inserted into the retention member 40 except for maintenance purposes, repair or replacement of the mast 60, or emergency use of the mast 60 apart from the watercraft 90, for example, to be waved by the user, at which time the mast 60 may be removed from the retention member 40.

In one embodiment of the invention the mast 60 is oriented at an angle divergent from a perpendicular to the upper surface 92 of the watercraft 90. The angle should be less than forty-five degrees from the perpendicular, and the angle of the mast 60 should orient the mast 60 substantially rearward with respect to the ordinary direction of movement of the watercraft 90. Angling the mast 60 as described achieves several benefits: because, due to visibility requirements of the operator of the watercraft 90, the safety signaling apparatus 1 is anticipated to be attached to the watercraft 90 behind the operator, a rearward angling of the mast 60 directs the shaft 64 of the mast 60 away from the operator so as not to distract the operator or interfere with the operation of the watercraft 90; when the signaling device 70 is a flag 72, angling the mast 60 allows the flag 72 to hang freely and more visibly in the absence of wind than if the mast 60 was oriented substantially vertically; a mast 60 so angled will create relatively less drag due to wind resistance; and a mast 60 so angled will better be able to bend past obstructions, such as low hanging branches, that might impact the mast 60 during operation of the watercraft 90. However, if the mast 60 is angled too far rearward, at an angle greater than forty-five degrees from the perpendicular, the signaling device 70 will not be as visible; the moment of torque on the signal end 66 of the mast 60 due to the weight of the signaling device 70 will be cause unacceptable bending of the shaft 64 of the mast 60; and the mast 60 will extend to far rearward from the watercraft 90, potentially interfering with nearby watercraft.

The signaling device 70 must be visually and/or audibly noticeable and must be suitably adapted to be attached to the signal end 66 of the mast 60. In ordinary operation, the signaling device 70 is supported by the mast 60 above the upper surface 92 of the watercraft 90. In the preferred embodiment the signaling device 70 comprises a flag 72. A flag 72 is light weight, inexpensive, and readily visible. In another preferred embodiment the flag 72 is constructed of a fluorescent, flexible plastic material, to provide greater visibility and durability. In other embodiments the signaling device 70 may comprise a siren, a bell, a light, a communication antenna, a GPS device, or a combination of two or more of such devices, such as a flag 72 and a light.

Figure 4:
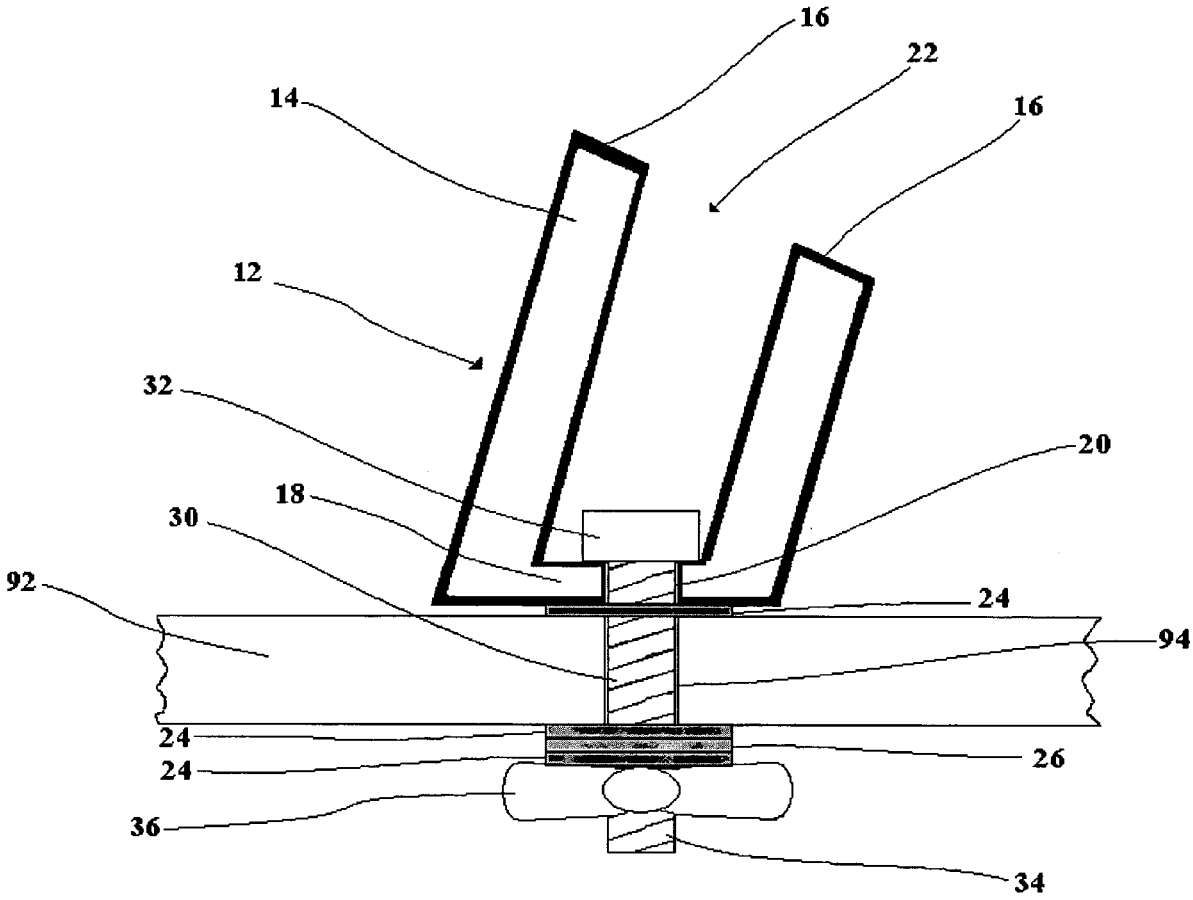
FIG. 4 is an elevation view of the preferred embodiment for attaching the base member to the upper surface of the watercraft.

In one embodiment of the invention, the base member 10 comprises a support cylinder 12, a retention bolt 30, and a retention device 36, whereby the support cylinder 12 is attached to the upper surface 92 of the watercraft 90 by the retention bolt 30 and retention device 36. See FIG. 4.

The support cylinder 12 should be constructed of a rigid, durable material, suitable for withstanding exposure to weather, salt water, and sunlight. One example of a suitable material is high impact polycarbonate plastic, but other suitable materials are well known in the art. The support cylinder 12 may also be constructed by means of injection molding.

The support cylinder 12 is substantially cylindrical and substantially hollow. It has a curved circumferential side wall 14, having a top edge 16, and a bottom surface 18 located adjacent to the curved side wall 14 opposite the top edge 16 of the curved side wall 14. The support cylinder 12 has a central aperture 20 passing completely through its bottom surface 18. The bottom surface 18 is substantially planar and is biased at an angle to the curved side wall 14 such that the curved side wall 14 of the base member 10 is oriented at an angle from the bottom surface 18. Thus, upon placing the support cylinder 12 upon a flat, horizontally oriented surface, the bottom surface 18 will lie flat against the surface and the curved side wall 14 will be canted at an angle off vertical. The angle should be less than forty-five degrees from vertical. So oriented, the base member 10 can support the mast 60 in the preferred orientation as described above.

In this embodiment the base member 10 is removably attached to the upper surface 92 of the watercraft 90 by use of the retention bolt 30 and retention device 36. The retention bolt has a head 32 and a shaft 34, with the bolt head 32 being larger than the central aperture 20 of the bottom surface 18 of the support cylinder 12. The bolt shaft 34 should be dimensioned to snugly pass through the central aperture 20 from the interior of the support cylinder 12, with the bolt head 32 adapted to be positioned within the support cylinder 12 against the bottom surface 18. So positioned, the bolt shaft 34 extends outward from the support cylinder 12 in a downward direction relative to the support cylinder 12. The upper surface 92 of the watercraft 90 is provided with an aperture 94 through which the bolt shaft 34 may pass. This aperture 94 should be dimensioned to snugly receive the bolt shaft 34. The retention bolt 30 must have an overall length such that the bolt shaft 34 can extend completely through both the bottom surface 18 of the support cylinder 12 and the upper surface 92 of the watercraft 90. The base member 10 is removably attached to the upper surface 92 of the watercraft 90 by placing the support cylinder 12 onto the upper surface 92 of the watercraft 90 with the bottom surface 18 of the support cylinder 12 placed against the upper surface 92 of said watercraft 90; the central aperture 20 of the support cylinder 12 is aligned with the aperture 94 in the upper surface 92 of the watercraft 90; the bolt shaft 34 of the retention bolt 30 is passed through the central aperture 20 of the support cylinder 12 and through the aperture 94 in the upper surface 92 of the watercraft 90, such that a portion of the bolt shaft 34 extends beyond the upper surface 92 of the watercraft 90; and the retention device 36 is attached to the portion of the bolt shaft 34 extending beyond the upper surface 92 of the watercraft 90, thereby securing the base member 10 to the upper surface 92 of the watercraft 90. The support cylinder 12 is rotated such that the curved side wall 14 is angled rearward. In the preferred embodiment, depicted in FIG. 4, the bolt shaft 34 of the retention bolt 30 is threaded, and the retention device 36 is a wing nut. In this embodiment the base member 10 may be easily attached and removed from the watercraft 90 with the use of tools, other than the initial need to form the aperture 94 in the upper surface 92 of the watercraft 90.

In another embodiment of the invention, the base member 10 further comprises at least one gasket 24. The gasket 24 is constructed of a flexible material, such as rubber, and should be water resistant. The gasket 24 is suitably adapted to be snugly placed over the bolt shaft 34 of the retention bolt 30, positioned between the retention device 36 and the bottom surface 18 of the support cylinder 12. So placed, the gasket 24 minimizes water seepage through the aperture 94 in the upper surface 92 of the watercraft 90. In another yet embodiment the base member 10 further comprises at least one washer 26. The washer 26 is constructed of a rigid material, such as stainless steel, and should be corrosion resistant. The washer 26 is suitably adapted to be placed over the bolt shaft 34 of the retention bolt 30, positioned between the retention device 36 and the bottom surface 18 of the support cylinder 12. So placed, the washer 26 improves the stability of the installation of the base member 10. In the preferred embodiment one gasket 24 is placed over the bolt shaft 34 and positioned between the bottom surface 18 of the support cylinder 12 and the upper surface 92 of the watercraft, a washer 26 is placed over the bolt shaft 34 and positioned between the upper surface 92 of the watercraft 90 and the retention device 36, and another gasket 24 is placed over the bolt shaft 34 and positioned between the washer 26 and the retention device 36. This configuration of gaskets 24 and washer 26 provides an excellent seal against water leakage through the aperture 94 in the upper surface 92 of the watercraft 90, and the gasket 24 closest to the retention device 36 helps prevent over tightening of the retention device 36. Other configurations of gaskets 24 and washers 26 may also be used.

Figure 6A:
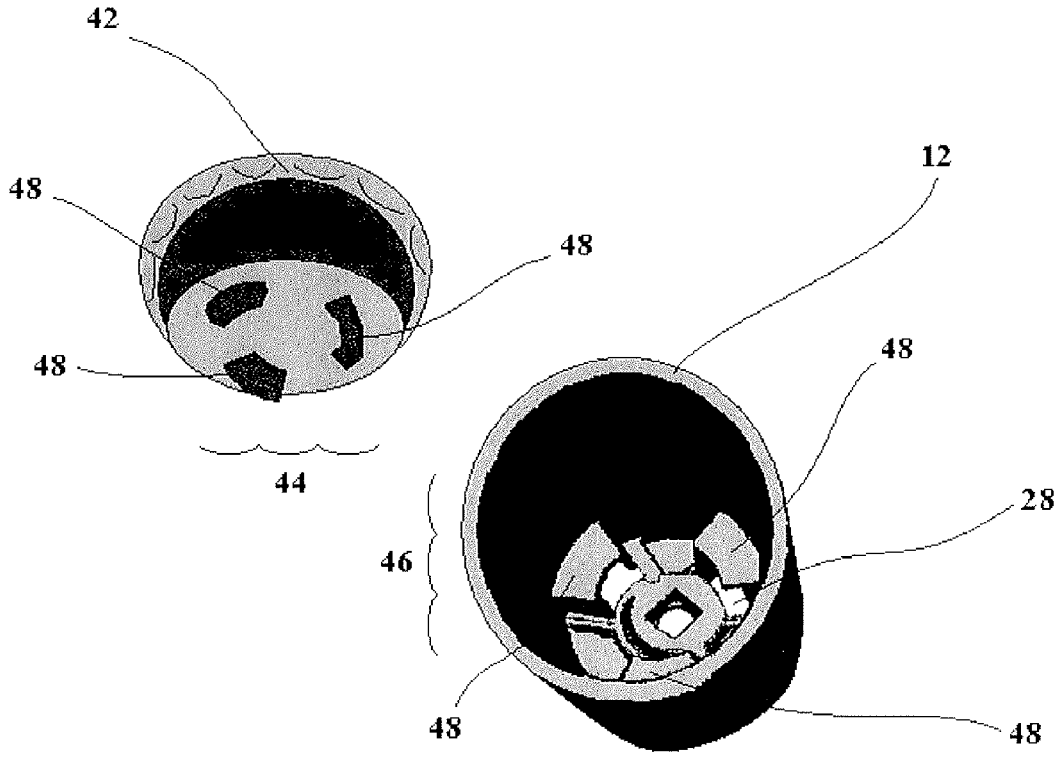
FIG. 6A is a perspective view of the cam locks associated with the attachment sub-member and the base member.
Figure 6B:
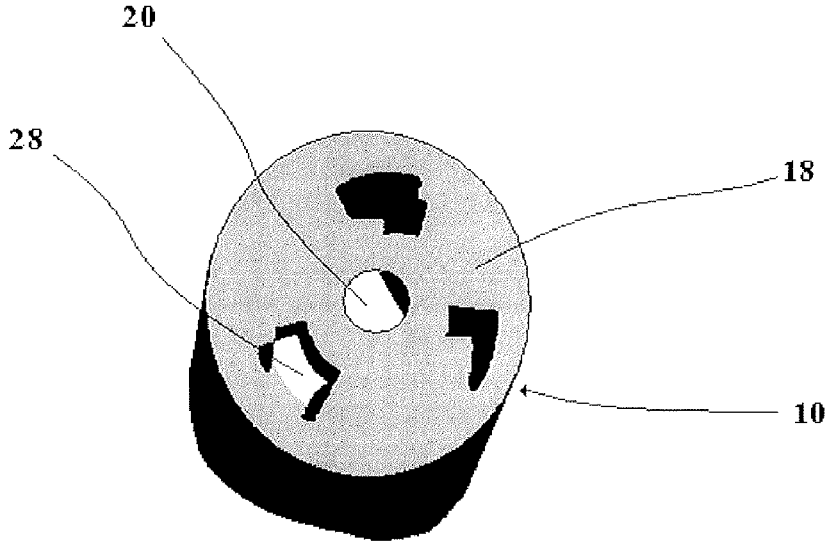
FIG. 6B is a perspective view of the underside of the base member.

In one embodiment of the invention, the bottom surface 18 of the support cylinder 12 of the base member 10 comprises a plurality of peripheral apertures 28. See FIG. 6B. Each such aperture 28 passes completely through the bottom surface 18 of the support cylinder 12. These apertures 28 permit any water accumulating within the support cylinder 12 to drain out the bottom.

Figure 5A:
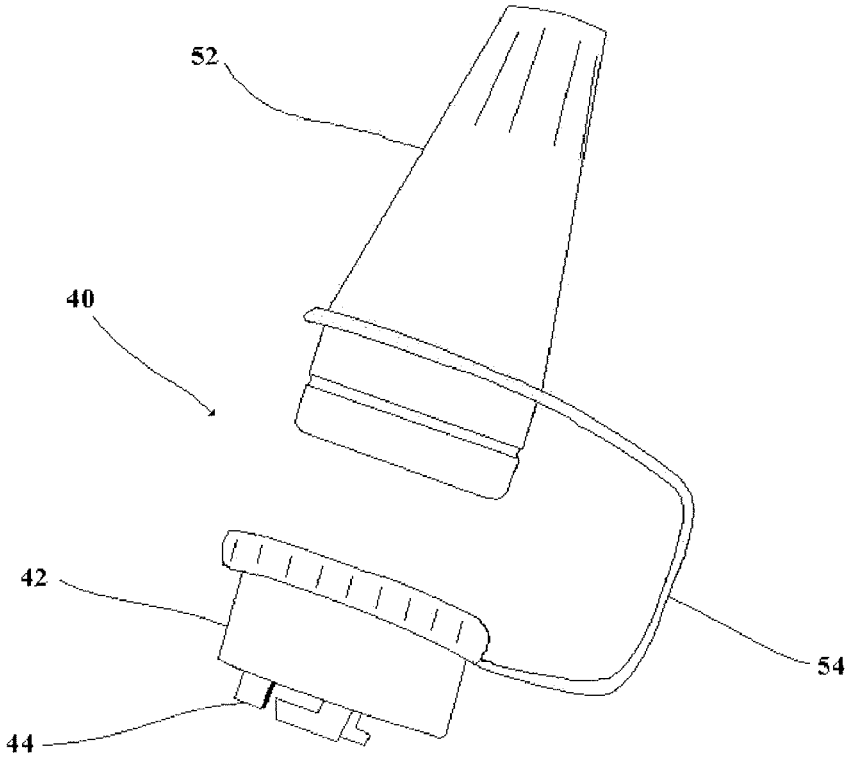
FIG. 5A is a perspective view of the sub-members of the retention member.
Figure 5B:
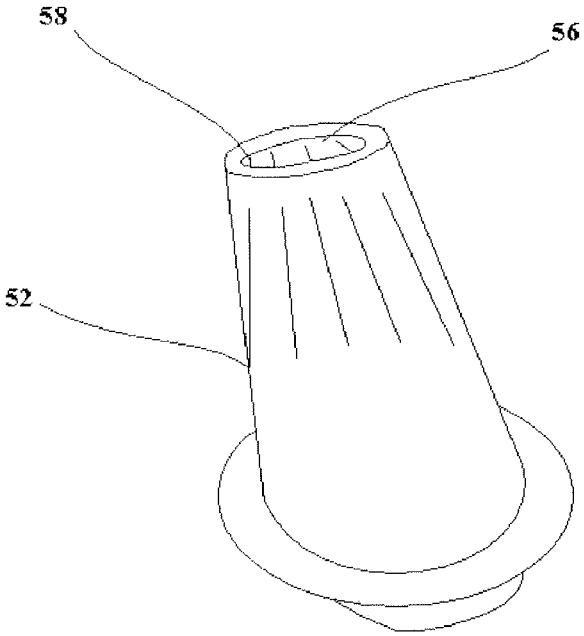
FIG. 5B is a perspective view of the attachment sub-member.

In the preferred embodiment of the invention, the retention member 40 is configured with two sub-members: an attachment sub-member 42 and a holding sub-member 52. See FIG. 5A. The attachment sub-member 42 is suitably adapted to be removably attached to the base member 10. The holding sub-member 52 suitably adapted to receive the retention end 62 of the mast 60 such that the retention end 62 of the mast 60 may be removably attached to the holding sub-member 52. The attachment sub-member 42 and a holding sub-member 52 are removably attached to each other by a connection means. The connection means may be any well-known means for removably attaching solid objects to each other without resorting the use of tools, including the use of snaps, slots, and the like. The connection means must be adapted to detach the attachment sub-member 42 from the holding sub-member 52 when forces acting on the mast 60 are sufficient to cause damage to the mast 60.

The retention member 40 should be constructed of a rigid, durable material, suitable for withstanding exposure to weather, salt water, and sunlight. One example of a suitable material is high impact polycarbonate plastic, but other suitable materials are well known in the art. The retention member 40 may also be constructed by means of injection molding.

In the preferred embodiment, the retention member 40 further comprises a security sub-member 54. The security sub-member 54 is constructed of a flexible material and has a first end and a second end, with the first end attached to the attachment sub-member 42 and the second end attached to the holding sub-member 52. The purpose of the security sub-member 54 is to retain together the attachment sub-member 42 and the holding sub-member 52 in the event they are detached by the connection means. Because the security sub-member 54 is flexible, the detached attachment sub-member 42 and holding sub-member 52 are free to move relative to each other. Further, because the attachment sub-member 42 is attached to the base member 10 and the holding sub-member 52 is attached to the mast 60, the security sub-member 54, in combination with the detached attachment sub-member 42 and holding sub-member 52, effects the purpose of permitted the mast 60 to move independently relative to the base member 10 under appropriate conditions. In the absence of the security sub-member 54, the mast 60 may still move independently relative to the base member 10 when the attachment sub-member 42 is detached from the holding sub-member 52, but then the mast 60 risks becoming lost.

In one embodiment, the attachment sub-member 42 is removably attached to the base member 10 by means of a cam lock mechanism, as is well known in the art. See FIG. 6A. A first cam lock 44 is formed into the attachment sub-member 42. A second cam lock 46 is formed within the interior of the support cylinder 12 of the base member 10, within the curved side walls 14 and above the bottom surface 18. The first and second cam locks 44,46 are suitably adapted to be rotationally engaged with each other. The top opening 22 of the support cylinder 12 is adapted to receive the attachment sub-member 42, and the attachment sub-member 42 is adapted to be inserted into the top opening 22 of the support cylinder 12. The retention member 40 is attached to the base member 10 by the attachment sub-member 42 being inserted into the top opening 22 of the support cylinder 12, the first cam lock 44 being positioned adjacent to the second cam lock 46, and the attachment sub-member 42 being rotated to cause the first and second cam locks 44,46 to engage, thereby securing the attachment sub-member 42 to the support cylinder 12. This configuration permits easy yet secure attachment of the retention member 40 to the base member 10 without the need for tools. Detachment of the retention member 40 from the base member 10 by counter-rotating the attachment sub-member 42 to disengage the cam locks 44,46 allows the user to store the mast 60, or to easily remove and independently wave the mast 60 in an emergency.

The cam lock mechanism used in the preferred embodiment utilizes a matched pair of three substantially equal sized locking slots 48. One of the pair of three locking slots 48 is arrayed circumferentially and at regular intervals about the attachment sub-member 42 and the other of the pair of three locking slots 48 is arrayed circumferentially and at regular intervals about the base member 10, with the spaces between individual locking slots 48 being greater than the length of each locking slot 48. This configuration permits easy mating of the attachment sub-member 42 and the base member 10 as described above without need to consider alignment of any particular locking slots 48 within the first and second cam locks 44,46. In the preferred embodiment, the underside of each locking slot 48 also includes a raised protrusion, such that when the first cam lock 44 and the second cam lock 46 engage, the raised protrusions of their respective mating locking slots 48 pass over each other, resulting in an even more secure engagement.

In another embodiment the holding sub-member 52 of the retention member 40 further comprises a top aperture 56, wherein the top aperture 56 has an interior diameter slightly larger that a diameter of the retention end 62 of the mast 60. Situated within the top aperture 56 is a plurality of longitudinal ribs 58 are suitably adapted to secure the retention end 62 of the mast 60 within the top aperture 56 when the retention end 62 of the mast 60 is inserted into the top aperture 56 of the holding sub-member 52 of the retention member 40. This configuration permits secure attachment of the mast 60 to the retention member 40, yet also permits the mast 60 to be removed if necessary for replacement or repair. An adhesive may also be used within the tap aperture 56 of the holding sub-member 52, but such use precludes the ability to remove the mast 60 from the retention member 40 if so desired.

Modifications and variations can be made to the disclosed embodiments of the invention without departing from the subject or spirit of the invention as defined in the following claims.

I claim:

1. A safety signaling apparatus comprising a base member, said base member suitably adapted to be removably attached to an upper surface of a watercraft;

a retention member, said retention member suitably adapted to be removably attached to the base member;

a mast, having a retention end, a shaft, and a signal end, wherein the retention end and the signal end are located at opposite ends of the shaft, and wherein the retention end of the mast is suitably adapted to be removably inserted into the retention member and the retention member is suitably adapted to receive the retention end of the mast; and a signaling device, said signaling device suitably adapted to be attached to the signal end of the mast;

wherein the base member comprises a support cylinder, wherein said support cylinder is constructed of a rigid, durable material, is substantially cylindrical and substantially hollow, and comprises a curved circumferential side wall having a top edge, a bottom surface, wherein the bottom surface is substantially planar and located adjacent to the curved side wall opposite the top edge of the curved side wall, said bottom surface being biased at an angle to the curved side wall such that the curved side wall of the base member is oriented at an angle from the bottom surface, said angle being less than forty-five degrees from a perpendicular to the bottom surface, a central aperture passing completely through the bottom surface, and a top opening bounded by the top edge of the curved side wall;

a retention bolt, said retention bolt having a head and a shaft, said bolt head being larger than the central aperture of the bottom surface and said bolt shaft suitably adapted to pass through the central aperture of the bottom surface, with said bolt head adapted to be positioned within the support cylinder and said bolt shaft adapted to extend outward from the support cylinder in a downward direction relative to the support cylinder, said bolt shaft suitably adapted to pass through an aperture in said upper surface of said watercraft; and a retention device, suitably adapted to be attached to the bolt shaft of the retention bolt;

whereby the base member is removably attached to said upper surface of said watercraft by placing the support cylinder onto said upper surface of said watercraft with the bottom surface of the support cylinder adjacent to said upper surface of said watercraft, with the central aperture of the support cylinder aligned with the aperture in said upper surface of said watercraft, the bolt shaft of the retention bolt passing through the central aperture of the support cylinder and through the aperture in said upper surface of said watcrcraft, and the retention device attached to the bolt shaft of the retention bolt, thereby securing the base member to said upper surface of said watercraft, the signaling device is supported by the mast above the upper surface of said watercraft, said mast being in a substantially upright orientation and being removably attached to the watercraft through the retention member and base member, and the retention member is suitably adapted to maintain the retention end of the mast in a fixed orientation in relation to the base member under certain operating conditions of said watercraft and to permit independent movement of the retention end of the mast relative to the base member under different operating conditions of said watercraft.

2. The safety signaling apparatus of claim 1 wherein the support cylinder is constructed of a high impact weather resistant plastic by means of injection molding.

3. The safety signaling apparatus of claim 1 wherein the bolt shaft of the retention bolt is threaded, and the retention device is a wing nut.

4. The safety signaling apparatus of claim 1 wherein the base member further comprises at least one gasket, constructed of a flexible material and suitably adapted to be placed over the bolt shaft of the retention bolt between the retention device and the bottom surface of the support cylinder.

5. The safety signaling apparatus of claim 1 wherein the base member further comprises at least one washer, constructed of a rigid material and suitably adapted to be placed over the bolt shaft of the retention bolt between the retention device and the bottom surface of the support cylinder.

6. The safety signaling apparatus of claim 1 wherein the bottom surface of the support cylinder of the base member comprises a plurality of peripheral apertures passing completely through said bottom surface.

7. A safety signaling apparatus comprising a base member, said base member suitably adapted to be removably attached to an upper surface of a watercraft;

a retention member, said retention member suitably adapted to be removably attached to the base member;

a mast, having a retention end, a shaft, and a signal end, wherein the retention end and the signal end are located at opposite ends of the shaft, and wherein the retention end of the mast is suitably adapted to be removably inserted into the retention member and the retention member is suitably adapted to receive the retention end of the mast; and a signaling device, said signaling device suitably adapted to be attached to the signal end of the mast;

wherein the retention member comprises an attachment sub-member suitably adapted to be removably attached to the base member;

a holding sub-member suitably adapted to receive the retention end of the mast such that the retention end of the mast may be removably attached to the holding sub-member;

a connection means suitably adapted to removably attach the holding sub-member to the attachment sub-member; and a security sub-member, wherein the security sub-member is constructed of a flexible material and has a first end and a second end, with the first end attached to the attachment sub-member and the second end attached to the holding sub-member;

whereby the signaling device is supported by the mast above the upper surface of said watercraft, said mast being in a substantially upright orientation and being removably attached to the watereraft through the retention member and base member, and the retention member is suitably adapted to maintain the retention end of the mast in a fixed orientation in relation to the base member under certain operating conditions of said watercraft and to permit independent movement of the retention end of the mast relative to the base member under different operating conditions of said watercraft.

8. The safety signaling apparatus of claim 7 wherein the attachment sub-member of the retention member comprises a first cam lock; and the base member comprises a support cylinder, wherein said support cylinder is constructed of a rigid, durable material, is substantially cylindrical and substantially hollow, and comprises a curved circumferential side wall having a top edge, a bottom surface, wherein the bottom surface is substantially planar and located adjacent to the curved side wall opposite the top edge of the curved side wall, a top opening bounded by the top edge of the curved side wall, wherein the top opening is suitably adapted to receive the attachment member of the retention member and the attachment member of the retention member is suitably adapted to be inserted into the top opening, and a second cam lock, said second cam lock located within the curved side walls and above the bottom surface of the support cylinder and suitably adapted to be rotationally engaged with the first cam lock of the attachment sub-member; and a securing means for removably attaching the support cylinder to said upper surface of said watercraft;

whereby the attachment sub-member may be removably attached to the base member by inserting the attachment sub-member into the top opening of the support cylinder, positioning the first cam lock adjacent to the second cam lock, and rotating the attachment sub-member to cause the first and second cam locks to engage, thereby securing the attachment sub-member to the support cylinder.

* * * * *